US007182484B2

(12) United States Patent
Buelow, II et al.

(10) Patent No.: US 7,182,484 B2
(45) Date of Patent: Feb. 27, 2007

(54) LIGHT APPLIANCE AND COOLING ARRANGEMENT

(75) Inventors: Roger F. Buelow, II, Gate Mills, OH (US); John M. Davenport, Middleburg Heights, OH (US); David Y. Lin, Castro Valley, CA (US)

(73) Assignee: Fiberstars, Inc., Solon, OH (US)

( * ) Notice: Subject to any disclaimer, the term of this patent is extended or adjusted under 35 U.S.C. 154(b) by 15 days.

(21) Appl. No.: 10/768,368

(22) Filed: Jan. 30, 2004

(65) Prior Publication Data

US 2004/0184284 A1 Sep. 23, 2004

Related U.S. Application Data

(60) Provisional application No. 60/452,729, filed on Mar. 7, 2003.

(51) Int. Cl.
*F21V 29/00* (2006.01)

(52) U.S. Cl. ..... 362/294; 362/373

(58) Field of Classification Search ..... 362/294, 362/101, 373, 367
See application file for complete search history.

(56) References Cited

U.S. PATENT DOCUMENTS 3,949,213 A 4/1976 Paitchell
4,419,716 A * 12/1983 Koo ..... 362/96
4,887,189 A * 12/1989 Garrett ..... 362/23
5,432,688 A * 7/1995 Tobias et al. ..... 362/101
5,556,188 A * 9/1996 Poppenheimer ..... 362/101
5,727,873 A * 3/1998 Tyson ..... 362/294
5,857,768 A * 1/1999 Ziegler et al. ..... 362/294
6,241,361 B1 * 6/2001 Thrasher et al. ..... 362/101
6,774,571 B2 * 8/2004 Choi et al. ..... 315/112
2004/0032740 A1 * 2/2004 Kurashima et al. ..... 362/373
2004/0156191 A1 * 8/2004 Biasoli et al. ..... 362/153.1

* cited by examiner

*Primary Examiner*—Sandra O'Shea
*Assistant Examiner*—Jacob Y. Choi
(74) *Attorney, Agent, or Firm*—Charles E. Bruzga; Bruzga & Associates

(57) ABSTRACT

Disclosed is a light appliance and a cooling arrangement, comprising a light appliance and a substantially sealed enclosure for the light appliance that gives off unwanted heat into surrounding air within the enclosure during operation. The enclosure has an external wall at least part of which is thermally conductive. A medium, cooler than the external wall of the enclosure, contacts the external wall. An air circulating device is provided for circulating air, heated by the electrical appliance or by the air circulating device, to the thermally conductive portion of the external wall for removing heat from the air by thermally dissipating the heat into the cooler medium through said thermally conductive portion.

27 Claims, 5 Drawing Sheets

LIGHT APPLIANCE AND COOLING ARRANGEMENT

This application claims priority from U.S. Provisional Application No. 60/452,729 filed Mar. 7, 2003.

FIELD OF THE INVENTION

The present invention relates to an light appliance contained within a substantially sealed enclosure and an associated cooling arrangement for removing unwanted heat generated by the light appliance. This increases the operating lifetime of the light appliance.

BACKGROUND OF THE INVENTION

By sealing a light source within an enclosed environment, the operating temperature of the source is seen to increase dramatically over its designed lifetime for an open-air operating temperature. This has the effect of reducing the lamp life to the point where the lamp is non-viable for consumer use. This is a particular concern for halogen and metal halide lamps, which use molybdenum foils to make electrical connections. These foils are at risk of premature oxidation if operated at high temperatures. The premature oxidation of the molybdenum lamp connections results in early lamp failure.

The rise of a sealed system's source temperature is due in part to the insulating qualities of the stagnant air within the sealed environment. The main cause of the source's temperature rise is the inability to remove heat from the source and from the sealed environment, and then to supply cooler air to the light source. Typically, the heat transfer from the source to an often cooler outer medium is primarily by conduction through essentially stagnant air within the enclosure.

In open-air operation, a cooling fan is often used to control the temperature of a light source. This works because of the large supply of relatively cool air available to draw over the source and ample room to exhaust hot air away from the source.

A second way to lower the temperature of a relatively hot component such as a light source is through the use of a heat sink. The heat sink increases the thermal mass and surface area of the component.

A purpose of the invention is to provide a system for more effectively cooling a light appliance within a substantially sealed environment.

SUMMARY OF THE INVENTION

A preferred form of the invention provides a light appliance and a cooling arrangement, comprising a light appliance and a substantially sealed enclosure for the light appliance that gives off unwanted heat into surrounding air within the enclosure during operation. The enclosure has an external wall at least part of which is thermally conductive. A medium, cooler than the external wall of the enclosure, contacts the external wall. An air circulating device is provided for circulating air, heated by the electrical appliance or by the air circulating device itself, to the thermally conductive portion of the external wall for removing heat from the air, by thermally dissipating the heat into the cooler medium through said thermally conductive portion.

The foregoing combination effectively cools a light appliance within a substantially sealed enclosure.

DESCRIPTION OF THE DRAWINGS

FIGS. 3 and 4 are partially in block form.

DETAILED DESCRIPTION OF THE INVENTION

Figure 1:
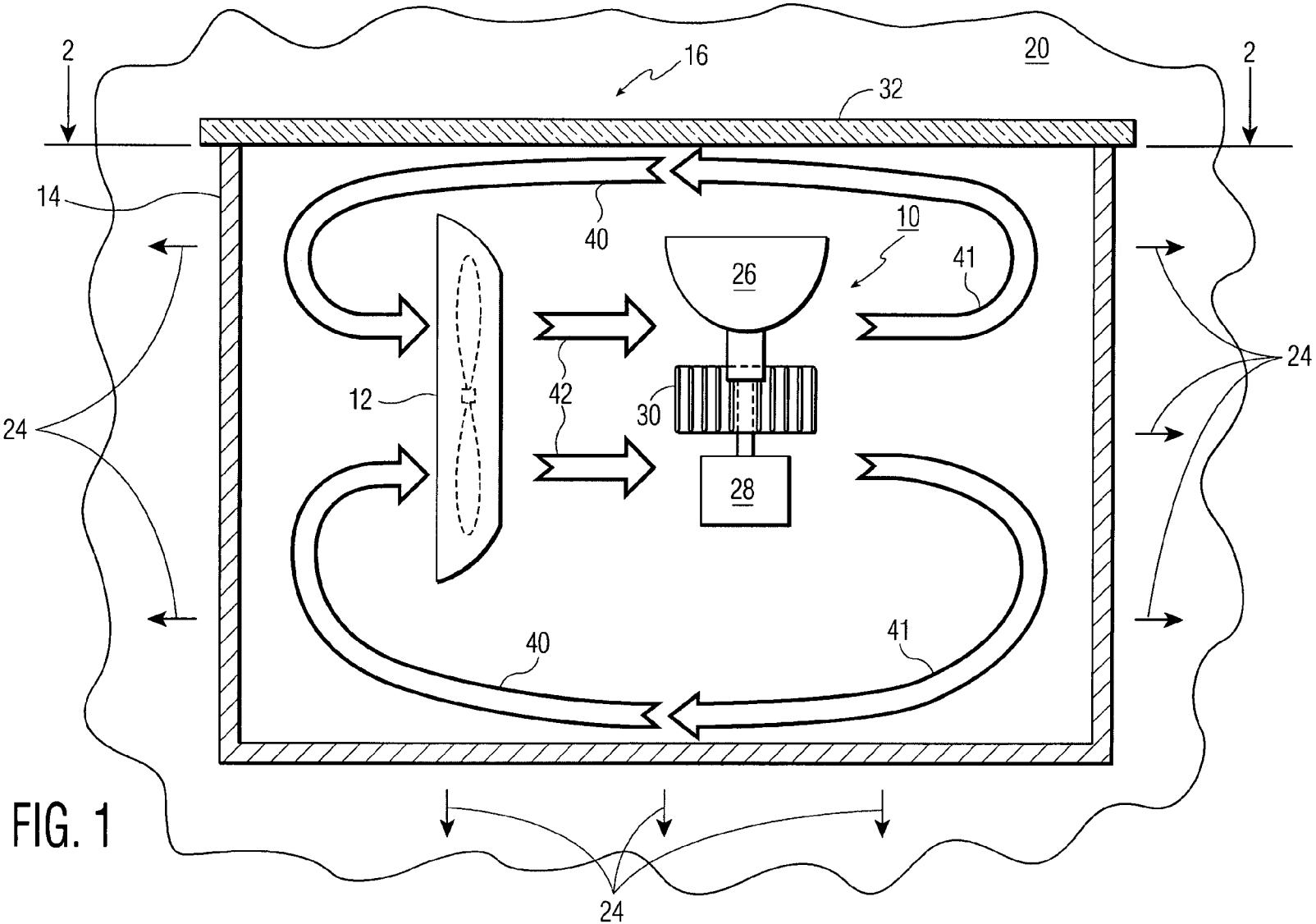
FIG. 1 is a top view of an light appliance with a cooling arrangement in accordance with the invention, partially in cross section and partially in block.

This description covers the three points of (1) general principles of the invention, (2) alternative cooling mediums that may be used, and (3) specific light appliance thermal issues.

1. General Principles

The first part of these General Principles does not refer to the drawings.

Optionally incorporating a heat sink for a light source component increases thermal mass and reduces the overall temperature of the component. By having a larger surface area, it is easier for thermal energy, which is to be dissipated away from the component, to be cooled through conduction with stagnant air, or through convection if used with a fan. To maximize the cooling effect, a heat sink could be used in conjunction with a cooling fan. Occasionally, a high power lamp will have metal connectors on the end(s) of the lamp which can also act as heat sinks.

To effectively use a cooling fan within a sealed environment, some portion or all of the walls of the sealed environment are thermally conductive, and could be formed of any metal or even a plastic that transfers heat well. A fan or other air circulating device is placed within the sealed environment to create what may be called a convection cell by blowing air over the hot source and/or heat sink. Air blowing over the source is heated by the source and carries thermal energy away from the source. The heated air comes in contact with the thermally conductive wall(s) and heats the relatively cool wall(s). The walls are kept relatively cool due to contact with the lower temperature immersion medium. When thermal energy leaves the air and enters the wall, the air temperature is lowered. This cooler air circulates and becomes the cooler input air to the fan, which completes the convection cell.

Of course, the fan does not bring in cool ambient air and exhaust heated air, as in a normal open-air system. Instead it only circulates the air sealed within the sealed environment, which works due to the conductive nature of the sealed environment's walls which are in contact with a medium that is much cooler than the light source and/or heat sink which is to be cooled.

This sealed environment is currently used in submerged-in-water applications where the water cools the walls of the sealed environment very well and has a very good ability to remove heat from the system. However, this cooling system is not limited to an underwater environment. If the air temperature outside the sealed environment is substantially lower than the source temperature, and the containing walls are made of material with sufficient thermal conducting qualities, a convection cell can be made using a fan within the sealed environment that would increase the operating lifetime of the source by reducing its temperature. The sealed environment could even be placed within a solid medium, such as a concrete wall, and as long as the walls of the environment are sufficiently cool to allow an efficient convection cell to be made within the sealed environment. Cooling mechanisms for use within a solid may include, but are not limited to, thermoelectric cells, water cooled pipes wrapped around the conductive walls, or even an exterior fan cooling off the sealed environment itself.

Now, referring to the drawings, FIG. 1 shows a top view of a light appliance 10, which gives off unwanted heat, together with a cooling arrangement, for explaining an overview of the invention. The cooling arrangement includes an air circulating device 12, a thermally conductive wall portion 14 of a substantially sealed enclosure 16, and a medium 20 that is cooler than wall portion 14 so as to remove heat from the wall portion 14 as indicated by arrows 24. Medium 20 may partially or fully surround enclosure 16.

Light appliance 10 may include, as shown, a light source 26, which may be supplied with an electrical driver 28 (shown in block). Driver 28 may comprise, for instance, an electrical or electromagnetic device for converting voltage and/or limiting current to light appliance 10. Light source 26 gives off unwanted heat during operation, and so may be supplied with a heat sink 30 for removing heat from the light source. Light source 26 may comprise, by way of example, a high pressure sodium lamp, a high pressure mercury vapor lamp, a halogen lamp, an incandescent lamp or an ultrahigh pressure mercury lamp.

To allow light to exit enclosure 16, the enclosure may includes optical material 32, typically comprising glass. The other wall material 14 of the enclosure may comprise stainless steel, thermally conductive plastic, or other material that is sufficiently thermally conductive to attain the cooling purpose set forth herein.

To prevent the ambient temperature in enclosure 16 from rising so high as to undesirably reduce the lifetime of light appliance 10, a cooling arrangement includes, as mentioned above, air circulating device 12, thermally conductive wall portion 14 of enclosure 16, and surrounding medium 20 that draws heat away from the enclosure as shown by arrows 24. Air circulating device 12 receives air 40 from the environment which has been cooled by contact with enclosure 16, and directs cooled air 42 onto appliance 10 for cooling the appliance.

By using the thermally conductive property of thermally conductive wall portion 14, heat from heated air 41 is drawn away—as indicated by arrows 24—into medium 20, which is substantially cooler than wall portion 14. When thermal energy is extracted from heated air 41, the resulting, cooled air is shown as 40 and 42. In this way, the ambient temperature within enclosure 16 can be kept below a destructive level that would undesirably shorten the lifetime of light appliance 10.

Air circulating device 12 may comprise an electrical fan, a heat pump or air pump, or other device for moving air, for instance.

2. Alternative Cooling Mediums

Figure 2:
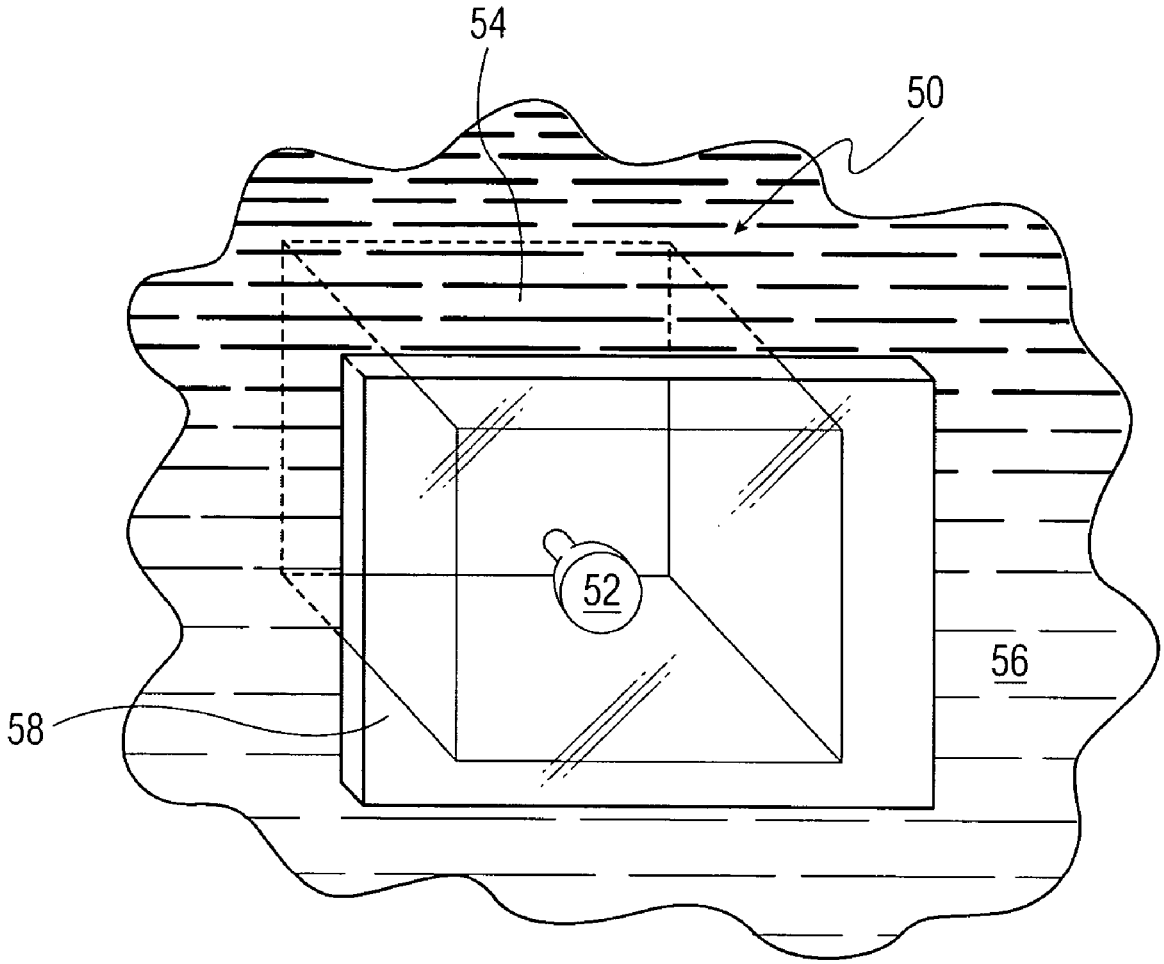
FIGS. 2–4 show simplified, isometric views of a sealed enclosure within different cooling mediums, the cross section of which mediums is taken at Line 2—2 in FIG. 1 but the front optical material being shown in full.
Figure 3:
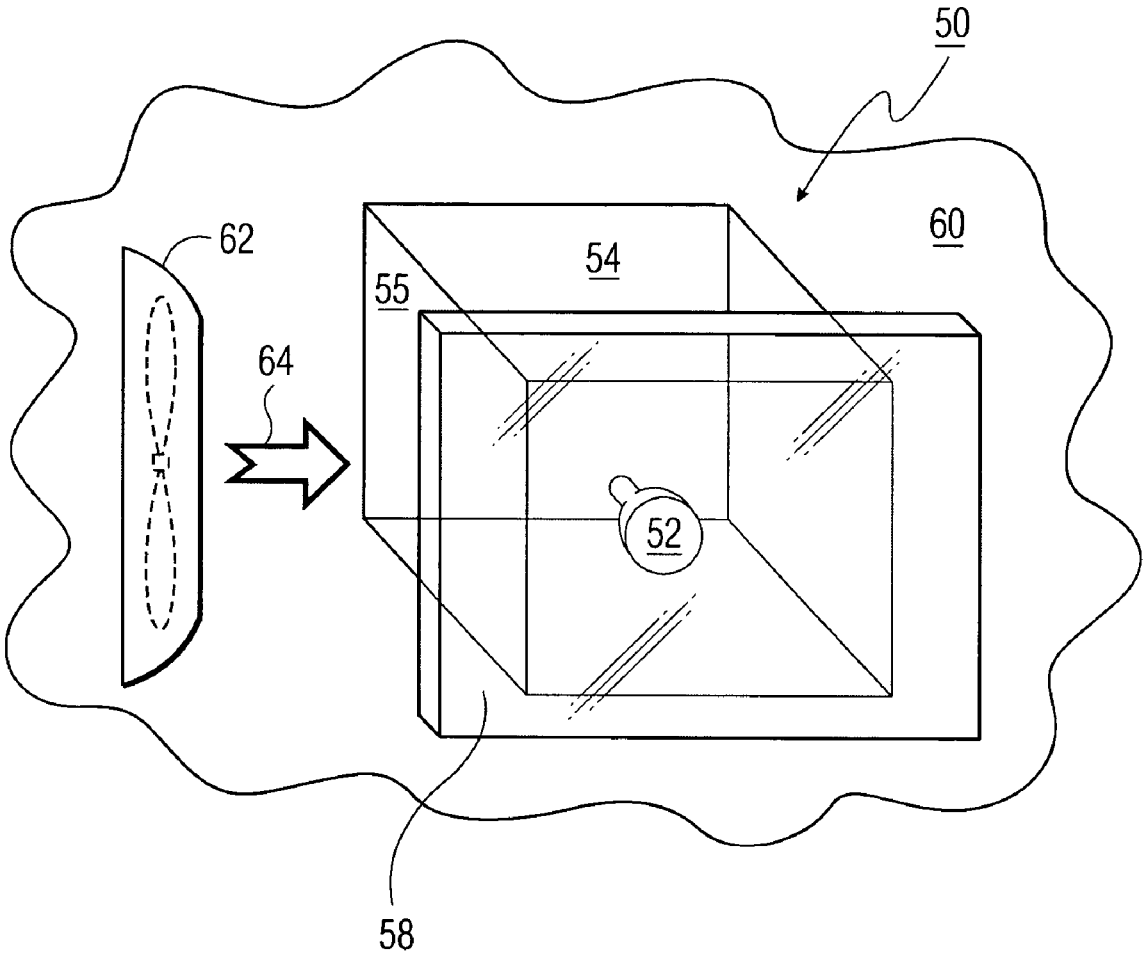
Figure 4:
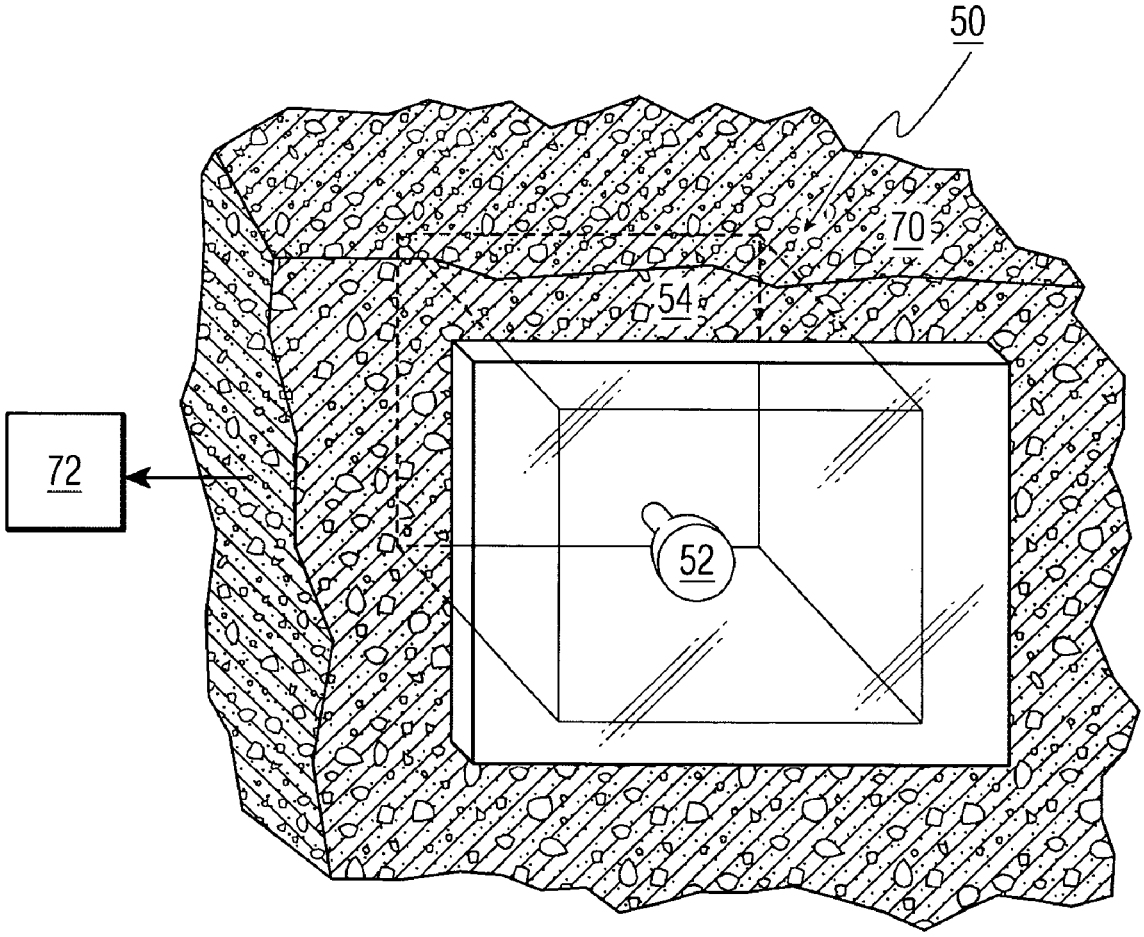

Various mediums that are cooler than a thermally conducive wall of an enclosure are shown in FIGS. 2–4.

FIG. 2 shows an embodiment of the invention in which an enclosure 50 for a light appliance 52 having a thermally conductive wall 54 contacts a medium 56 of water. Part of light appliance 52 can be seen through optical material 58, with other structure within the enclosure being simplified or omitted for simplicity of illustration. The principles of operation explained in connection with FIG. 1 apply to this embodiment, so that medium 56 extracts heat from light appliance 52 via thermally conductive wall 54, for instance. This is an example of the extraction of heat by medium 20 (FIG. 1) from light appliance 10.

FIG. 3 shows the same enclosure 50 and associated parts as in FIG. 2, but shows a different medium 60 comprising air. An optional air circulating device 62, such as an electrical fan, directs a flow of air 64 against thermally conductive wall portions 54, 55, etc. of the enclosure so as to extract heat from the enclosure through convection.

As with FIG. 2, FIG. 4 shows the same enclosure 50 and associated parts, but shows a different medium 70 comprising a solid, such as concrete. An optional cooling device 72 may be employed to extract heat from solid medium 70, such as a thermoelectric cooling cell or water-cooled pipes preferably located near the conductive wall portions, e.g., 54, of enclosure 50.

3. Specific Light Appliance Thermal Issues

Figure 5A:
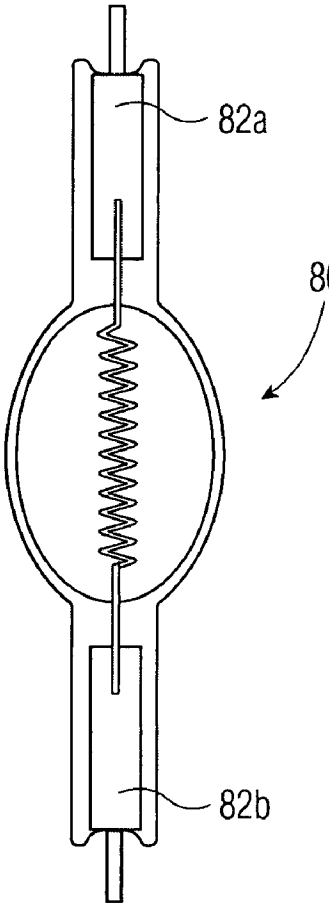
FIGS. 5*a* and 5*b* show filamented and discharge lamps, respectively, with thermally sensitive molybdenum leads.
Figure 5B:
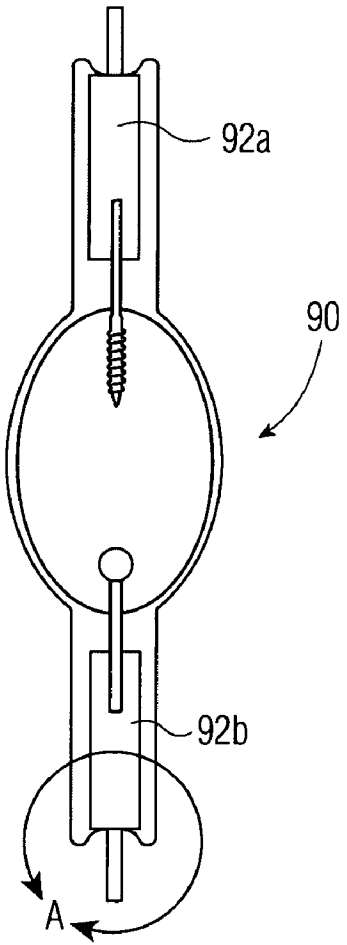
Figure 5C:
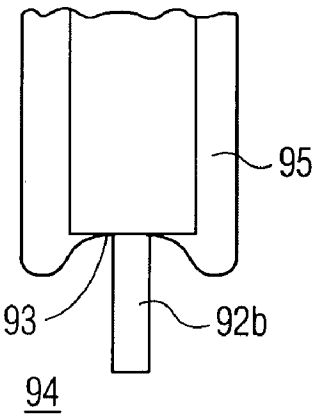
FIG. 5*c* shows an enlarged, detail view taken at Circle A in FIG. 5*b*.

As described in the Background of the Invention above, electrical leads made of molybdenum for lamps such as halogen lamps or metal halide lamps face premature oxidation if subjected to high temperatures. FIG. 5*a* shows a filamented halogen lamp having molybdenum lead portions 82*a* and 82*b* exposed to the ambient. Similarly, FIG. 5*b* shows a discharge lamp 90 such as a metal halide lamp with molybdenum lead portions 92*a* and 92*b* exposed to the ambient. FIG. 5*c* shows an enlarged, detail view of a seal region 93 between a molybdenum foil 92*b* and vitreous material 95, to highlight the area of the molybdenum foil that is exposed to air 94. FIG. 5*c* also applies to the filamented lamp 80 of FIG. 5*a*. Any of the light sources described herein that employ either of the foregoing types of lamps benefit considerably from maintaining the ambient within the enclosure below a destructive temperature that would undesirably shorten lifetime.

Figure 5D:
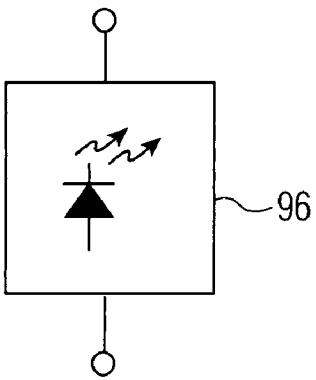
FIG. 5*d* shows an LED in block form, which exhibits thermal sensitivity.

Additionally, a light source comprising a light-emitting diode (LED) 96 such as shown in FIG. 5*d* exhibits thermally sensitivity. When an LED is subjected to high temperatures, such device is affected in several ways. The spectral output of the light produced by the device will shift, with higher temperatures generally producing light of longer wavelengths. This means two LEDs that are the same color when first started (and at the same temperature) will diverge in color as they heat up to different levels. This can be a particular concern in pool lighting where the same color is desired for both relatively cool pools and relatively warm hot tub pools.

The biggest thermal concern with LEDs is the effect of high temperature on device life. With repeated thermal cycling to high temperatures, the thermal expansion mismatches between different layers of the device will cause cracking and early failure of the device. This is a major problem for other solid state devices, such as the central processing chips in personal computers that are not related to the invention. In those cases a fan is used to force air from outside the enclosure over the device to keep it cool and prolong life of the device.

Finally, regarding LEDs, device efficiency changes with temperature. Modest increases in temperature of only 10–20 degrees C. have a small effect on device efficiency, i.e., with a drop of only 2–10%. But, if there is no limit to operating temperature, so-called runaway situations can result and temperatures in the device can rise upwards to 100 degrees C. This can cause a drop in efficiency of up to 50%, so an LED's output will drop by half as it warms up.

So, LEDs also greatly benefit from the cooling arrangement of the present invention.

While the invention has been described with respect to specific embodiments by way of illustration, many modifications and changes will occur to those of ordinary skill in the art. It is, therefore, to be understood that the appended claims are intended to cover all such modifications and changes as fall within the true scope and spirit of the invention.

What is claimed is:

1. A light appliance and a cooling arrangement, comprising:

a) a light appliance;

b) a liquid-tight enclosure for the light appliance that gives off unwanted heat into surrounding air within the enclosure during operation, the enclosure having an external wall at least part of which is thermally conductive;

c) an electrical driver within the enclosure comprising an electrical or electromagnetic device for converting voltage or limiting current to the light appliance or for both connecting voltage and limiting current to the light appliance;

d) an air circulating device within the enclosure for circulating air, heated by the light applicance or by the air circulating device, to the thermally conductive portion of the external wall;

e) a medium that is in contact with said external wall of the enclosure; the medium (i) having adequate thermal conductivity and (ii) being sufficiently cooler than the external wall of the enclosure that the air circulating device removes sufficient heat from the air by dissipating the heat into the cooler medium through said thermally conductive portion so as to substantially increase lifetime of the light appliance;

f) the enclosure being free of a channel formed between an interior surface of the external wall of the enclosure to receive forced air heated by the light appliance and a sleeve liner surrounding the light appliance, for controllably recirculating forced air within the enclosure;

g) the external wall being free of multiple heat fins extending between an inner surface of the external wall and the sleeve liner; and h) the enclosure being free of a one-way air valve that opens a passage into the interior of the enclosure from the exterior of the enclosure when the pressure on a portion of the valve at the exterior of the enclosure exceeds the pressure on a portion of the valve at an interior of the enclosure.

2. The combination of claim 1, wherein the light appliance comprises a filamented lamp.

3. The combination of claim 1, wherein the filamented lamp comprises molybdenum leads.

4. The combination of claim 1, wherein the lamp is a halogen lamp.

5. The combination of claim 1, wherein the light appliance comprises a high intensity discharge lamp.

6. The combination of claim 5, wherein the high intensity discharge lamp comprises molybdenum leads.

7. The combination of claim 5, wherein the lamp is a high pressure sodium lamp, a high pressure mercury vapor lamp, or an ultrahigh pressure mercury lamp.

8. The combination of claim 1, wherein the light appliance further comprises a heat sink for removing heat from the light appliance.

9. The combination of claim 1, wherein the light appliance further comprises a heat sink for removing heat from the light appliance.

10. The combination of claim 9, wherein the light appliance further comprises a heat sink for removing heat from the LED.

11. The combination of claim 1, wherein the medium comprises water.

12. The combination of claim 1, wherein the medium comprises a solid.

13. The combination of claim 12, wherein the solid includes a cooling device for cooling the solid to a sufficiently low temperature to allow substantial dissipation of heat from within the enclosure into the solid through said thermally conductive portion.

14. The combination of claim 1 wherein the medium comprises air.

15. The combination of claim 14, wherein the air comprises circulating air.

16. The combination of claim 1, wherein the air circulating device comprises an electrical fan.

17. The combination of claim 1, wherein the air circulating device comprises a heat pump or an air pump.

18. The combination of claim 1, wherein the thermally conductive wall comprises stainless steel.

19. The combination of claim 18, wherein the thermally conductive wall further comprises glass.

20. The combination of claim 1, wherein the thermally conductive wall comprises a thermally conductive plastic.

21. The combination of claim 1, wherein the external wall is free of multiple heat fins projecting outwardly from an outer surface of the external wall.

22. A light appliance with a cooling arrangement, comprising:

a) a light appliance;

b) a liquid-tight enclosure for the light appliance that gives off unwanted heat into surrounding air within the enclosure during operation, the enclosure having an external wall at least part of which is thermally conductive; and c) an electrical driver within the enclosure comprising an electrical or electromagnetic device for converting voltage or limiting current to the light appliance or for both connecting voltage and limiting current to the light appliance;

d) an air circulating device within the enclosure for circulating air, heated by the light appliance or by the air circulating device, to the thermally conductive portion of the external wall;

e) a medium comprising water that is in contact with said external wall of the enclosure; the medium (i) having adequate thermal conductivity; and (ii) being sufficiently cooler than the external wall of the enclosure that the air circulating device removes sufficient heat from the air by dissipating the heat into the cooler medium through said thermally conductive portion so as to substantially increase lifetime of the light appliance; and f) the enclosure being free of a channel formed between an interior surface of the external wall of the enclosure to receive forced air heated by the light appliance and a sleeve liner surrounding the light appliance, for controllably recirculating forced air within the enclosure;

g) the external wall being free of multiple heat fins extending between an inner surface of the external wall and the sleeve liner; and h) the enclosure being free of a one-way valve that opens a passage into the interior of the enclosure from the exterior of the enclosure when the pressure on a portion of the valve at the exterior of the enclosure exceeds the pressure on a portion of the valve at an interior of the enclosure.

23. The combination of claim 22, wherein the light appliance comprises a filamented lamp or a high intensity gas discharge lamp.

24. The combination of claim 22, wherein the light appliance further comprises a heat sink for removing heat from the lamp.

25. The combination of claim 22, wherein the thermally conductive wall comprises stainless steel.

26. The combination of claim 25, wherein the thermally conductive wall further comprises glass.

27. The combination of claim 22, wherein the external wall is free of multiple heat fins projecting outwardly from an outer surface of the external wall.

* * * * *